US006945084B2

(12) United States Patent
Bindernagel et al.

(10) Patent No.: US 6,945,084 B2
(45) Date of Patent: Sep. 20, 2005

(54) ROLLING MILL FOR ROLLING OR SIZING METAL PIPES

(75) Inventors: Ali Bindernagel, Wermelskirchen (DE); Ali Bindernagel, Jr., Solingen (DE); Hermann Moeltner, Grevenbroich (DE); Dieter Pfeiffer, Monheim (DE); Heinrich Potthoff, Hilden (DE)

(73) Assignee: Kocks Technik GmbH & Co. KG, Hilden (DE)

( * ) Notice: Subject to any disclaimer, the term of this patent is extended or adjusted under 35 U.S.C. 154(b) by 146 days.

(21) Appl. No.: 10/371,310

(22) Filed: Feb. 21, 2003

(65) Prior Publication Data

US 2003/0217579 A1 Nov. 27, 2003

Related U.S. Application Data

(63) Continuation-in-part of application No. 09/819,321, filed on Mar. 28, 2001, now abandoned.

(30) Foreign Application Priority Data

Mar. 28, 2000 (DE) ..... 100 15 285

(51) Int. Cl.[7] ..... B21B 31/10; B21B 35/04

(52) U.S. Cl. ..... 72/224; 72/239

(58) Field of Search ..... 72/224, 235, 238, 72/239, 249

(56) References Cited

U.S. PATENT DOCUMENTS

| | | | | | |
|---|---|---|---|---|---|
| 3,494,166 | A | * | 2/1970 | Severin et al. | 72/239 |
| 3,861,187 | A | * | 1/1975 | Leeuwestein | 72/224 |
| 6,041,635 | A | * | 3/2000 | Cattaneo et al. | 72/235 |
| 6,209,376 | B1 | * | 4/2001 | Zhang | 72/224 |

FOREIGN PATENT DOCUMENTS

| | | | |
|---|---|---|---|
| DE | 31 43 244 | * | 5/1983 |
| WO | WO 98/06515 | * | 2/1998 |

* cited by examiner

*Primary Examiner*—Lowell A. Larson
(74) *Attorney, Agent, or Firm*—Michael J. Striker

(57) ABSTRACT

A rolling mill for rolling or sizing of metallic pipes, bars and wires has a plurality of rolling units which are arranged on a straight line close to one another and can be exchanged in total, partly or individually, each of the rolling units having at least three rolls which are arranged in a star-like configuration around a rolling mill axis, drive shafts and motors each driving a respective one of the rolls in all the rolling units, a rolling unit housing provided for the rolling units, roll bearings provided for the rolls, and multi-part roll shafts provided for supporting the rolls so that the rolls can be exchanged without dismounting of the rolling unit housing and the roll bearings, the rolling units holding the rolls inside and outside of the rolling mill in their operational positions.

23 Claims, 5 Drawing Sheets

ROLLING MILL FOR ROLLING OR SIZING METAL PIPES

CROSS REFERENCE TO A RELATED APPLICATION

This application is a continuation-in-part of U.S. patent application Ser. No. 09/819,321 filed on Mar. 28, 2001 now abandoned.

BACKGROUND OF THE INVENTION

The present invention relates to a rolling mill for rolling or sizing of metallic pipes, bars, or wires.

Patent document WO 98/06515 discloses a rolling mill which includes a plurality of rolling units arranged on a straight line close to one another. The rolling units are arranged exchangeably in the rolling mill. They each have three rolls which are arranged in a star-shaped configuration around a rolling mill axis. Only some rolling units, namely two last rolling units arranged at the outlet side, have rolls which are each driven from an own drive shaft. The remaining rolling units, which are provided in a substantially greater number, have each only one drive shaft which drives directly the roll shaft of each roll which has a horizontally extending rotary axis. The torque of the drive shaft is transmitted to the both other roll shafts by means of bevel gears which are arranged on all roll shafts. In order to retain the bevel gears in engagement with one another, in these rolling units a significant radial adjustment of the roll shafts and thereby of the rolls is not provided. For the both last rolling units arranged at the outlet side, the rolls can be however adjusted in a radial direction since they are driven individually and are supported radially movably.

This known rolling mill has the substantial disadvantage that the majority of the rolling units, namely those with only one drive shaft, can not be loaded sufficiently high. The reason for this is that, the roll bearings for receiving the forces and the bevel gears for transmission of the torque must be arranged within a equilateral triangle which is formed by the rotary axes of the rolls. Thereby the outer dimensions of the roll bearings and of the bevel gears are limited and as a result the magnitude of the rolling forces to be received and the torque to be transmitted are limited as well. An increase of the triangle of the rotary axis would lead to larger rolls. Larger rolls however increase the distance between the rolling units, which leads to an increase of the fraction of unusable, not measurable end portions of the rolling product. Moreover, larger rolls are more expensive in manufacture and treatment. Further, with larger rolls, higher investment cost are needed for the whole rolling mill. Therefore an increase of the triangle of the rotary axes can not be considered as an acceptable solution of the problem.

In addition to their insufficient load capability, the rolling units with only one driving shaft have the disadvantage, that with such rolling units the arrangement inside the rolling unit housing is especially expensive, since in addition to the roll bearings also the bevel gears must be accommodated inside the triangle of the rotary axes. A radial adjustment of the rolls is possible, but only with substantial structural expenses. High structural expenses without the roll adjustment lead to many components and thereby to high manufacturing and operational costs.

The expensive arrangement inside the rolling unit housing has a further disadvantage in that, the exchange of the rolls is complicated and time consuming. For this purpose it is necessary to open the rolling unit housing and to partially dismount the roll bearings as well as the bevel gears. After the roll exchange, a corresponding mounting expense is needed. For saving mounting work and time, the rolls are re-machined in the built-in condition. However, for this purpose additional special machines are required.

In the known rolling mill a substantially great part of the rolling units has each only one drive shaft and thereby the rolling mill has all disadvantages of these rolling units. The rolling mill is not sufficiently loadable, it has complicated and therefore expensive rolling units and requires a high expense for exchange and re-machining of the rolls.

In order not to put up with more disadvantages, in the known rolling mill the radial adjustability of the rolls in the rolling units with only one drive shaft and thereby in the majority of the rolling units is dispensed with. This leads in such rolling units to substantially increased costs, since in such rolling units the rolls are used up faster. In rolling units without or without sufficient radial adjustability, worn up rollers must be re-machined with a great material removal. Also with these rolling units unfavorable rolling programs require extensive material removals.

SUMMARY OF THE INVENTION

Accordingly, it is an object of the present invention to provide a rolling mill for rolling or sizing metal pipes, bars or wires, which does not possess the above mentioned disadvantages, but instead can be loaded higher, and also can be adjusted faster as well as with lower expense of labor, time and costs to changing requirements of the operation.

In keeping with these objectives, the above mentioned problem is resolved in an inventive rolling mill for rolling or sizing of metal pipes, bars, or wires, which has a plurality of rolling units arranged on a straight line close to one another and which can be quickly exchanged completely, partially, or individually, and each having at least three rolls arranged in a star-shaped configurations around a rolling mill axis, wherein in all rolling units all rolls and drive shafts are driven from its own motor, and the rolls are supported by multi-part roll shafts and can be exchanged without dismounting of a rolling unit housing and roll bearings. The rolling units hold the rolls inside and outside of the rolling mill in their operational positions. This objective is achieved by the combination of the above mentioned features.

Thereby a rolling mill is provided which, with the same dimensions of its rolls and rolling units, is loadable considerably higher, since all rolls of all rolling units of the rolling mill have an own drive shaft driven directly by its own motor, and therefore the bevel gears for transmission of the torques of the individual roll shafts are dispensed with. Therefore, inside the equilateral triangle which is formed by the rotary axes of the rolls, a free space is formed which otherwise would be required for the bevel gears. This free space can be used completely or partially for the roll bearings, so that they can be designed larger and therefore with higher load capability without increasing the triangle which is formed by the rotary axes of the rolls and thereby without increasing the rolls. The larger roll bearings make possible also higher rolls forces with the rolls of the same size and the unchanged small distance of the rolling units. Moreover, the torques which act on the rolls are independent of the transmission ability of the bevel gears and can be higher. Finally, it is possible to roll products with a higher deformation resistance or with a lower rolling temperature. Also, the rolling units can be produced with lower expenses and assembled simpler, while the bevel gears and other individual parts can be dispensed with.

The multi-part design of the roll shaft makes possible an axial clamping of the rolls each between the facing end surfaces of the two partial shafts. Thereby strength-reducing connections between the rolls and the roll shafts with keys or similar elements, which are often utilized, are avoided. The multi-part design of the roll shafts first of all makes possible a fast roll exchange. For this purpose the axial clamping force between the both part shafts is released, they are moved a little from one another, and the roll can be removed in a radial direction from the rolling unit. After this, another roll can be inserted in a radial direction into the rolling unit between the both part shafts and clamped there. A disassembly of the rolling unit housing and/or the roll bearings is not performed. Such a fast roll exchange provides for a possibility for using less rolling units, since the preparation time for a new use for the rolling units which are not located in the rolling mill is so short, that they are already available when the rolling units in use must be exchanged. Therefore in the new rolling mill hardly more than two sets of rolling units are needed. Moreover, with the fast and simple roll exchange, also a re-machining of the rolls in the built-in condition and the special machine which are needed for this are superfluous, since the rolls can be dismounted and mounted fast for re-machining on standard lathes. Since moreover all rolling units of the rolling mill can quickly be exchanged completely, partially, or individually, the rolling mill has less and shorter stoppages.

In accordance with a preferable embodiment of the invention, the rolling units have a one-part rolling unit housing. This is possible because of the inventive individual drive of the rolls and the elimination of the bevel gears. As a result, the rolling unit housing can be produced with significantly lower expenses, since the parting surfaces which have to be machined with great care and in several steps and then are sealed are also dispensed with, and also numerous openings for keys and connecting screws which otherwise must connect the both parts of the rolling unit housing in alignment with one another.

In the inventive rolling mill the rolls of either all rolling units, or of only a few, or of no rolling units, can be adjustable. Which possibility is selected depends on the rolling program and the respective operation conditions, for which the rolling mill must be suitable. However, it is especially advantageous when in all rolling units the roll bearings are arranged in eccentric bushings and they can be turned in a stepwise manner for radial adjustment of the rolls and then can be arrested in any of several rotary positions. In this manner in all rolling units several distances between the rolling mill axis and the rotary axes of the rolls are available. Rolls with worn down working surfaces can be remachined in such a rolling mill to the same pass shape and size as the original ones, and then used again. After re-machining, the rolls inevitably have smaller ideal roll diameters and thereby smaller distances between the rolling mill axis and the roll rotary axes. These other distances can be adjusted by turning of the eccentric bushings. The rolls not only can be utilized again, but even at the same unit position and with the same pass diameter. The relatively expensive rolls can be used so much more frequently that the roll costs are reduced significantly. The radial adjustment of the rolls can be carried out with a low expense, since in the inventive rolling mill no bevel gears are necessary for roll adjustment. Roll adjustment can be performed preferably outside of the rolling line, for example in a roll work shop.

It is further recommended that at least in the two last rolling units arranged at the outlet side, the roll bearings are arranged in eccentric bushings, and they are radially adjustably in a stepless manner for a stepless radial adjustment of the rolls also when the rolling units are assembled ready for operation. They are adjustable regardless whether in the remaining rolling units the rolls are steplessly adjustable or not. This has the advantage that in the product range of the rolling mill, all thinkable manufacturing dimensions of the rolling product can be obtained and also in any sequence. To a limited extent a change of the final dimensions is possible without a change of rolls or rolling units. Also with this embodiment in the case of rolling units which are not continuously adjustable in the mill line it is advantageous to provide for the possibility of a stepped radial adjustment outside of the mill line, e.g. in the roll workshop.

As a rule, the number of those rolling units whose rolls are not steplessly radially adjustable with the rolling unit ready for operation, is greater than the number of the rolling units with steplessly radially adjustable rolls. Thereby the expenses and the cost for the production of the rolling mill are reduced, since a minimum of expensive rolling units with steplessly radially adjustable rollings are utilized.

It is also advantageous when the rolling units whose rolls are not steplessly radially adjustable with the rolling unit assembled ready for operation, have rolls with a different ideal roll diameter than the rolling units with the steplessly radially adjustable rolls. This improves the possibilities of a new use re-machined rolls and also saves rolls costs.

It is also desirable that all unit positions are suitable for rolling units with steplessly radially adjustable rolls and for rolling units with not steplessly radially adjustable rolls. It is thereby possible to use all rolling units on all unit positions and to adapt the rolling mill better to the corresponding requirements.

In accordance with a recommended embodiment the drive shafts of the rolls and the shafts of their motors extend coaxially to the corresponding roll rotary axes. It is especially advantageous when the motors with the shafts which form an angle to a horizontal plane and assume the same angular position to one another are arranged on or in a joint frame. This simplifies the devices for coupling the rolling units to and uncoupling the rolling units from the drive of their rolls during exchange of the rolling units. Also, the exchange of the rolling units is thereby accelerated and the actual stoppages of the rolling mill are shortened. Preferably, a reducer transmission is arranged on or in a joint frame between the motors and the drive shafts of the rolls. It is considered to be advantageous when the reducer transmission is formed as a planetary transmission.

In accordance with a further embodiment of the present invention the reducer transmissions of several or all motors with the same angular position are assembled in a housing which is formed as a joint frame. Here also several or all motors with the same angular position can be flanged on a housing of the reducer transmission, formed as a joint frame. In accordance with another embodiment, the motors and reducer transmissions of one or several rollers whose roll rotary axes form an angle with a horizontal plane, are assembled to form a drive unit.

It is especially advantageous when the joint frame or frames or drive units are linearly displaceable in direction of the associated rotary axis of the rolls. It is however also possible that the joint frame or frames or drive units are turnable about a turning axis extending parallel to the rolling mill axis. Also for shifting of the joint frames or drive units a linkage mechanism can be provided. It is also advantageous when the joint frame or frames or drive units arranged above the rolling mill axis are supported by a supporting bridge of concrete. Such a supporting bridge provides all possibilities for mounting of the frames or drive units and acts in a damping manner for eventually occurring vibrations.

An unit exchanging device is provided for simple and fast exchange of either all, or some, or individual rolling units from the rolling line of the rolling mill, and replacement by other rolling units. In a recommended embodiment one or several rolling units are arranged on one or several unit changing cars from which they can be moved into the rolling line or onto which they can be moved from the rolling line. The unit changing cars perform the displacement of the rolling units in or opposite to the rolling direction along the rolling mill. They can be also used for transportation of the rolling units from the rolling mill to the roll workshop and back.

In this embodiment of the rolling mill, the drive for moving the rolling units can be arranged under the motors and in some cases the reducer transmission for the rollers with horizontally extending rotary axes. The drive can have a number of horizontally extending working cylinders which can be coupled selectively to an associated rolling unit on a unit changing car or in a unit receptacle of the rolling mill. As an alternative, the drive for moving the rolling units can have two horizontally extending work cylinders. They can be arranged in the region of the end faces of the rolling mill which are located at the inlet and at the outlet. They engage a shifting beam which is arranged on the operator's side of the rolling units, extends parallel to the rolling mill axis and is displaceably transversely to the latter. Each rolling unit can be selectively coupled to the shifting beam.

In accordance with another embodiment of the rolling mill, one or several rolling units stand on one or several unit changing cars, and the rolling units with the unit changing cars are movable in and out of the rolling line. In this case the unit changing cars are used for holding the rolling units during the rolling.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
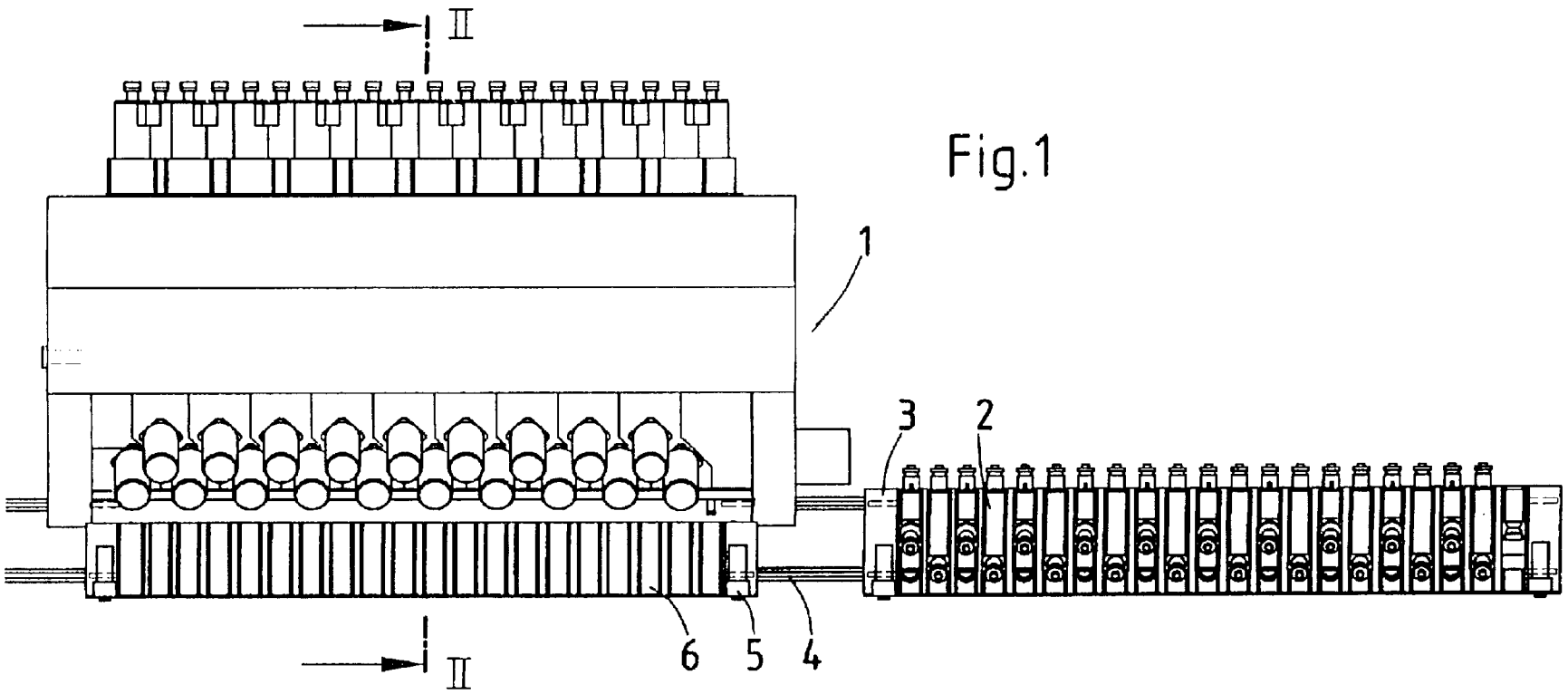
FIG. 1 is a plan view of a rolling mill in accordance with the present invention.

FIG. 1 shows a rolling mill 1 with a great number of rolling units 2. Several rolling units are arranged on a unit changing car 3 closely to one another. The rolling units 2 on the unit changing car 3 come out of a unit workshop, where the rolling units 2 are prepared to be introduced into the rolling mill 1 and where they can be placed in the required sequence on the unit changing car 3. Rails 4 lead to the rolling mill 1. A second unit changing car 5 with empty unit receptacles 6 is located before it, while its rolling units 2 are located in the rolling mill 1 and therefore can not be seen on the plan view of FIG. 1. These rolling units 2 when needed can be moved from the rolling mill 1 onto the unit changing car 5 all together, only a few or individually. This unit changing car 5 will then move to the side, so that the unit changing car 3 can move with its other rolling units 2 in front of the rolling mill 1. Then the rolling units 2 on the unit changing car 3, which are required in the rolling mill 1 are brought to their unit positions in the rolling mill 1.

Figure 2:
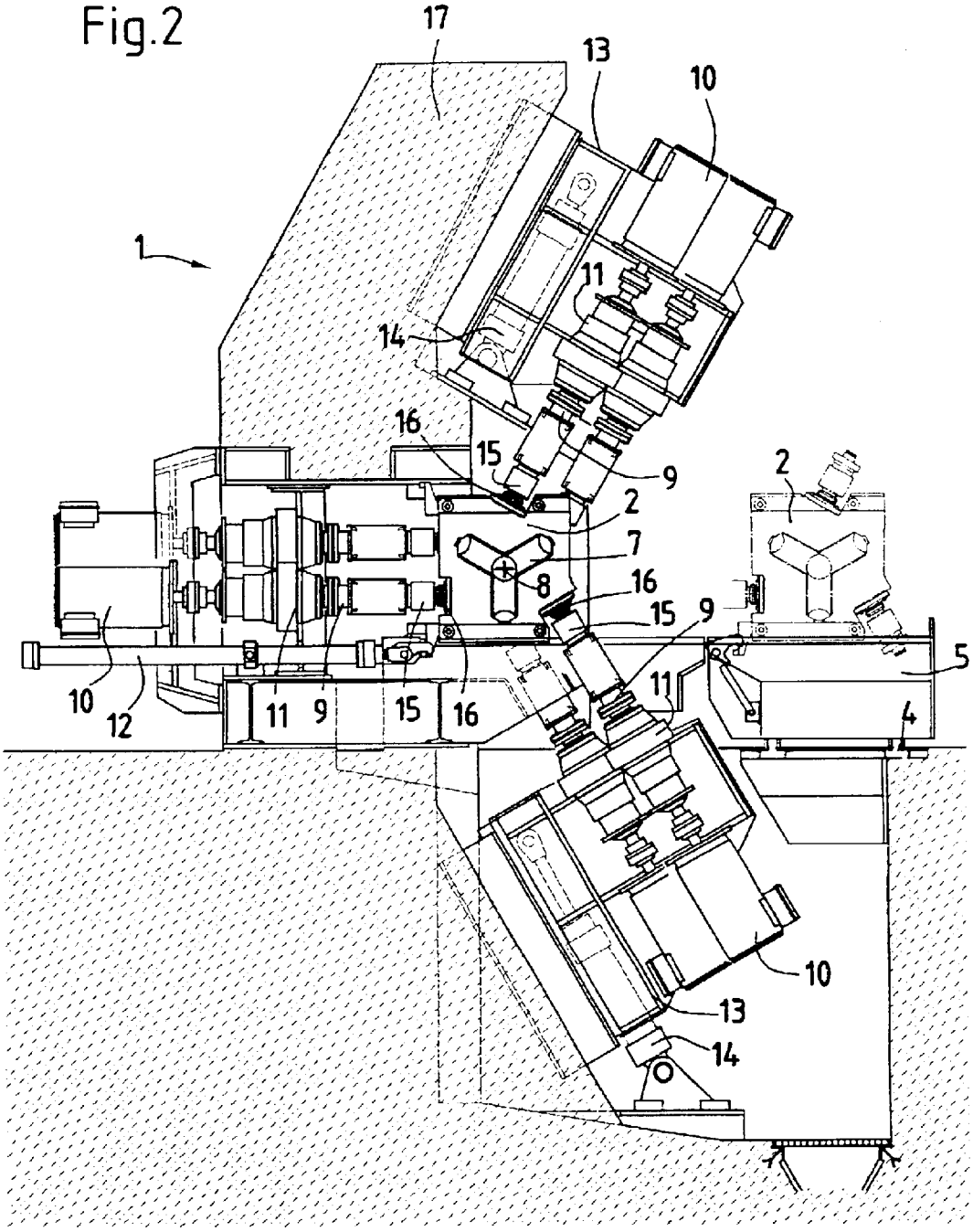
FIG. 2 is a view showing a section taken along the line II—II in FIG. 1.

In FIG. 2 the unit changing car 5 is shown in a cross-section. Dash-dot lines identify the position of the rolling unit on the unit exchanging car 5, after it was removed from the rolling mill 1. The rolling unit 2 actually is located in FIG. 2 in its operational position. Three rolls 7 are arranged in a star-like configuration in the rolling unit 2. They surround a straight horizontal rolling mill axis 8 which is illustrated in FIG. 2 only as an intersection point.

All rolls 7 are driven separately. Each drive is performed through a drive shaft 9 from a motor 10. Reducer transmissions 11 are arranged between the drive shafts 9 and the motors 10. They are formed as planetary transmissions. The drive shafts 9, motors 10 and reducer transmissions 11 which are not provided with reference numerals are associated with a neighboring rolling unit 2.

At each unit position, a work cylinder 12 which can extend horizontally is located under those of the motors 10, the reducer transmissions 11 and the drive shafts 9 for the rolls 7 which have horizontally extending rotary axes. It can be selectively coupled with the associated rolling unit 2, so that it can be shifted from the rolling mill 1 out on a unit changing car 3, 5 or pulled from the unit changing car 3, 5 into the rolling mill 1. The rolling units 2 hold the rolls 7 in their operational positions inside and outside of the rolling mill 1.

The motors 10 and the reducer transmissions 1 1 whose shafts form an angle to a horizontal plane and which assume the same angular positions relative to one another are arranged on a common frame 13. The frames 13 can be linearly displaced by a further work cylinder 14 in direction of the facing rotary axes of the rolls 7. Couplings 15 provide a possibility for separating and coupling of the drive shafts 9 with the rolls shafts 16, which are located nearly completely in the rolling units 2 and therefore can not be seen in FIG. 2. When pressurized medium is correspondingly supplied to the work cylinder 14, the joint frames 13 and with them the motors 10, the reducer transmissions 11 and the drive shafts 9 are moved from the rolling units 2 so that, the parts of the couplings 15 are separated and the rolling units 2 can be shifted horizontally, for example onto the unit changing car 5. The couplings 15 of the horizontal extending drive shafts 9 also disengage. Correspondingly the roll shafts 16 of the rolling units 2 can be again coupled with the drive shafts 9, when the rolling units 2 are located in their operational position. The frames 13 are then moved by the work cylinders 14 to the rolling units 2 until the parts of the couplings 15 are again engaged with one another.

The joint frame 13 arranged in FIG. 2 above the rolling mill axis 8 is held by a supporting bridge 17 of concrete. In the embodiment shown in FIG. 3 this is not the case. Here the joint frame 13 arranged above the rolling mill axis 8 is held by at least one turning arm 18 which is turnable about a turning axis 19 extending parallel to the rolling mill axis 8. The turning movement can be performed both by work cylinders and also by motors, what however is not shown in FIG. 3. The turning movement of the upper frame 13 releases not only the couplings 15, but also it can be performed so far that the region above the rolling unit 2 is free and the rolling unit 2 can be engaged from above with a crane and therefore exchanged. There is also a possibility to operate without the unit changing cars 3, 5. In other aspects the embodiment of FIG. 3 corresponds to that of FIG. 2.

Figure 3:
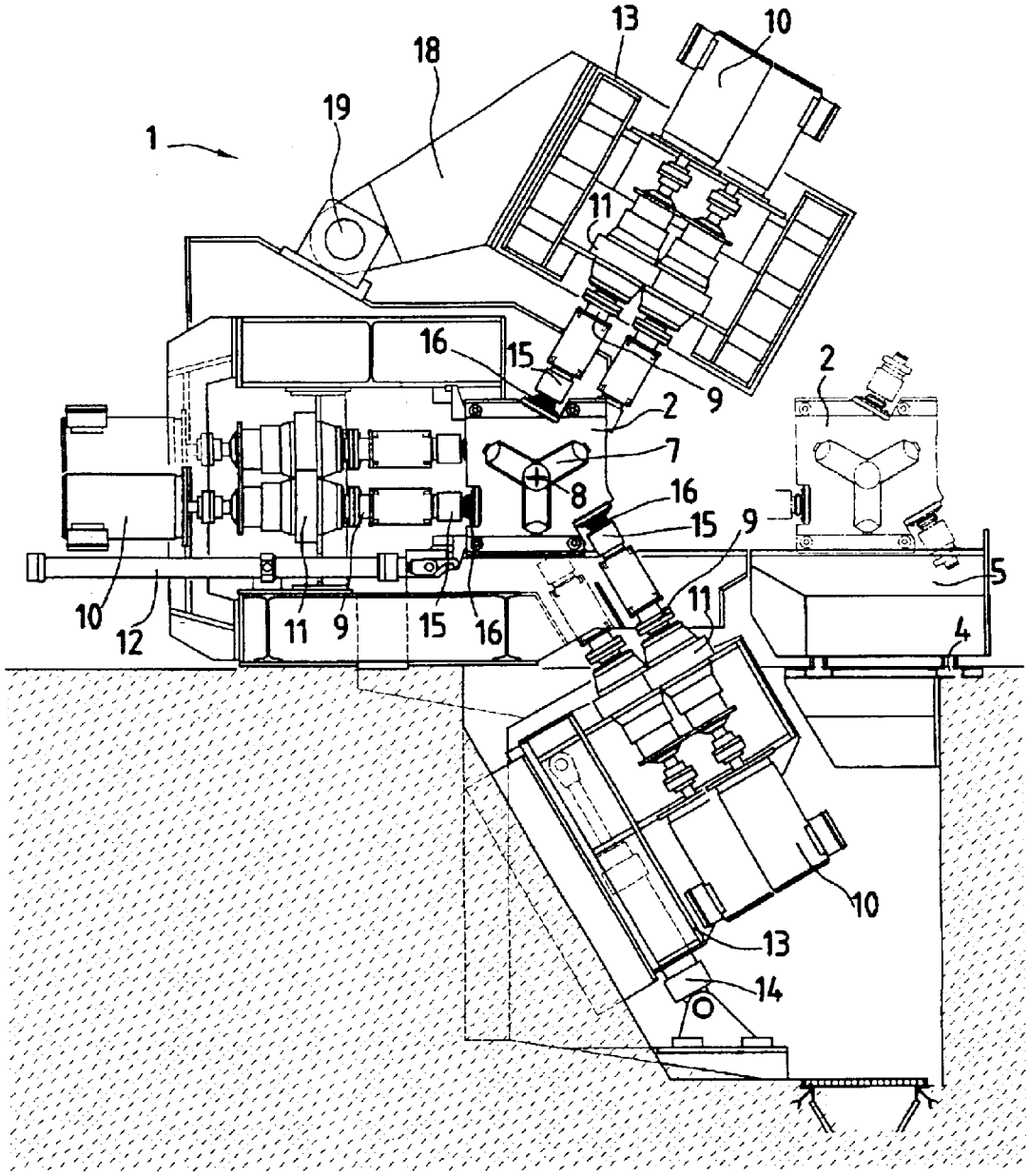
FIG. 3 is a view showing a rolling mill corresponding to FIG. 2, but provided with a turnable upper rolling drive.
Figure 4:
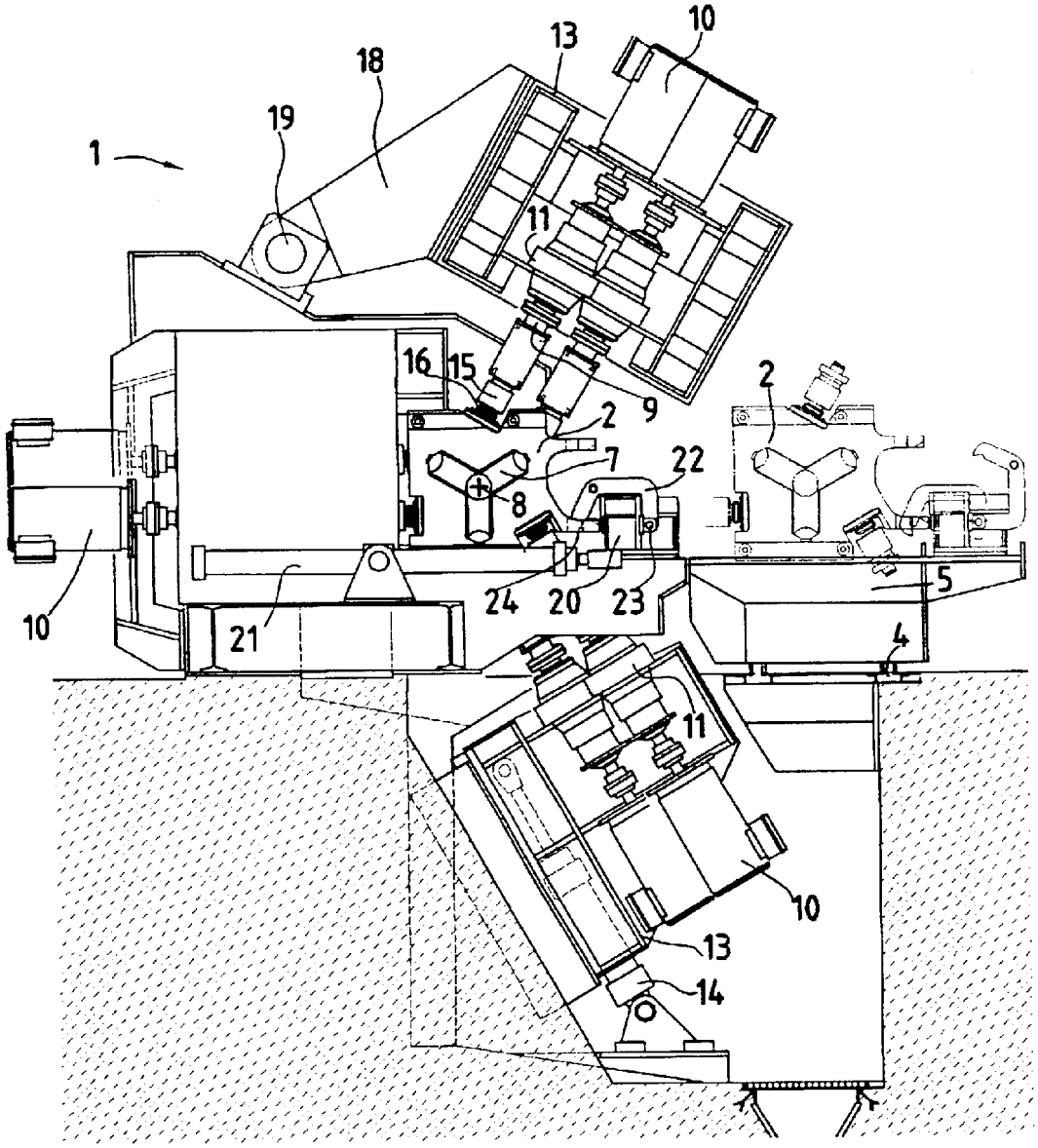
FIG. 4 is a side view of a rolling mill corresponding to FIG. 3, but provided with another rolling unit changing device.

FIG. 4 shows a rolling mill of FIG. 3 but with another device for fast exchange of the rolling units 2. A shifting beam 20 is arranged at the operation side of the rolling unit 2. It extends parallel to the rolling mill axis 8 and is displaceable transversely to it. The transporting beam 20 is driven by two work cylinders 21 which are supplied with pressurized medium. Each of the work cylinders is arranged in the region of end faces of the rolling mill 1 at the inlet side and outlet side, so that in FIG. 2 only one of the work cylinders can be seen. Each rolling unit 2 can be coupled with the shifting beam 20 by a catch 22 arranged on each unit position and turnable about a pivot 23. For this purpose the catch 22 which is turnable by hand engages in a recess 24 of the associated rolling unit 2.

During exchange of the rolling units 2, the shifting beam 20 together with the coupled rolling units 2 is shifted onto the unit changing car 5. Then the shifting beam 20 is uncoupled from its work cylinders 21, and they are moved back to their initial position. The unit changing car 5 can then move together with the shifting beam 20 to a unit workshop. The other unit changing car 3 with prepared rolling units 2 also carries a shifting beam 20 on which the work cylinders 21 are coupled, when the unit change car 3 is located in the correct position in front of the rolling mill 1. The prepared rolling units 2 are then shifted into the rolling mill 1 by the shifting beam 20.

Figure 5:
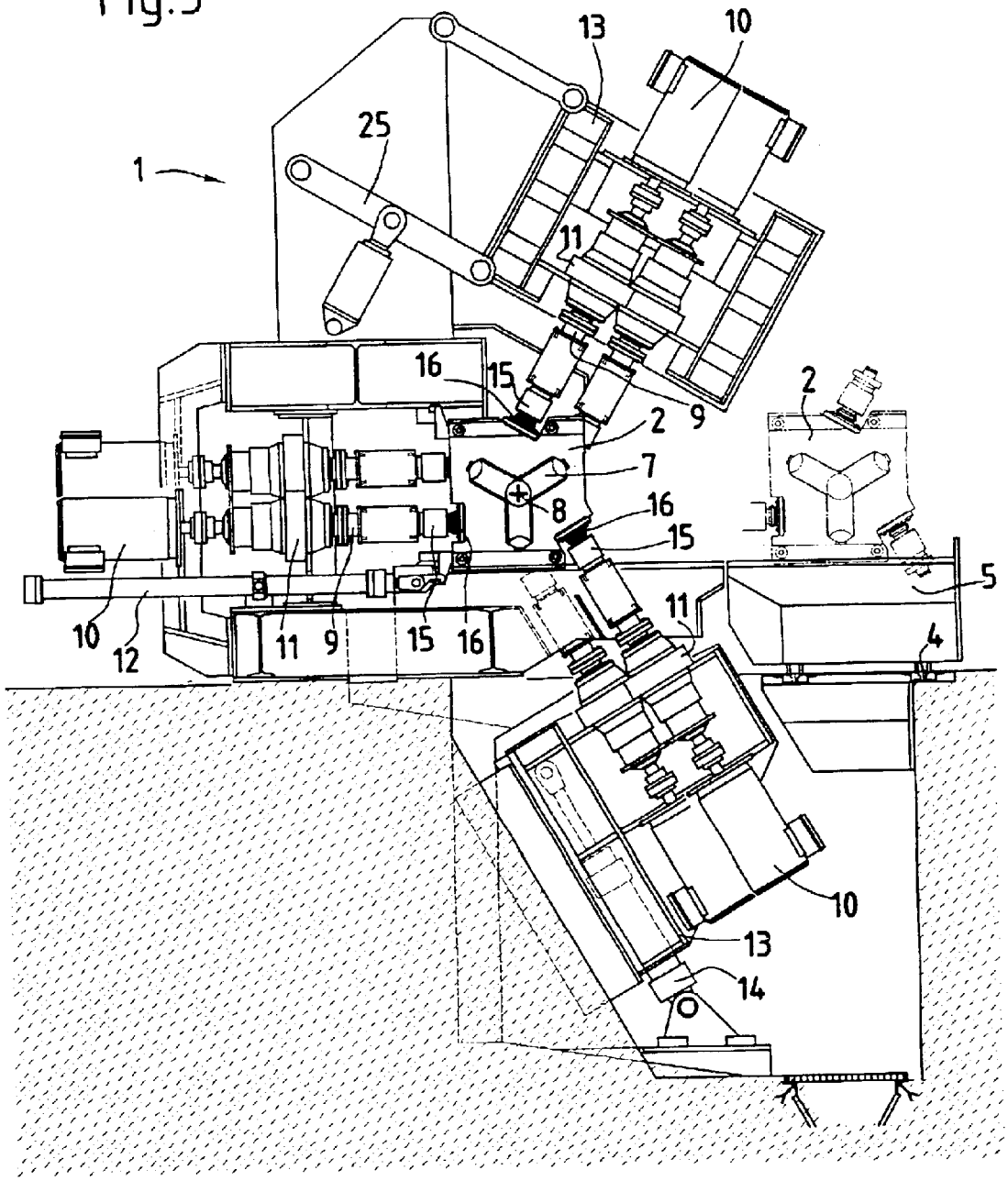
FIG. 5 is a view showing a rolling mill corresponding to FIG. 3, but provided with a linkage mechanism for shifting of the upper rolling drive.

The embodiment of the rolling mill of FIG. 5 differs from that of FIG. 3 only by a linkage mechanism 25 for holding and moving the upper frame 13, instead of the turning arm or arms 18.

It will be understood that each of the elements described above, or two or more together, may also find a useful application in other types of constructions differing from the types described above.

While the invention has been illustrated and described as embodied in rolling mill for rolling or sizing metallic pipes, bars or wires, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A rolling mill for rolling or sizing of metallic pipes, bars and wires, comprising a plurality of rolling units which are arranged on a straight line close to one another and cart be exchanged in total, partly or individually, each of the rolling units having at least three rolls which are arranged in a star-like configuration around a rolling mill axis; drive shafts and motors each driving a respective one of said rolls in all said rolling units; each rolling unit comprising a rolling unit housing; roll bearings provided for said rolls, whereby the roll bearings of at least one roll in unit are arranged in eccentric bushings of said rolls, which bushings of said rolls are fixedly arranged with respect to lateral movements in said rolling unit housing; and multi-part roll shafts provided for supporting said rolls so that said rolls can be exchanged without dismounting of said rolling unit housing and said roll bearings.

2. A rolling mill as defined in claim 1, wherein said rolling unit housing of said rolling units is a one-part rolling unit housing.

3. A rolling mill as defined in claim 1; and further comprising means for radial adjustment of said rolls and including eccentric bushings in which said roll bearings of all said rolling units are arranged, said eccentric bushings being turnable in a stepped fashion and arrestable in several rotary positions for radial adjustments of said rolls.

4. A rolling mill as defined in claim 1, wherein at least two of said rolling units located at an outlet side of the rolling mill have means for radial adjustment of said rolls and including eccentric bushings in which said roll bearings are arranged, said roll bearings of said at least two rolling units being steplessly radially adjustable when said rolling units are built-in and ready for operation, for stepless radial adjustment of said rollers.

5. A rolling mill as defined in claim 4, wherein all or several of such said rolling units, whose rolls are built-in and ready for operation are stepwise radially adjustable, comprises rolls, which are radially adjustable in a stepped-fashion outside the rolling mill.

6. A rolling mill as defined in claim 5, wherein all unit positions are suitable for said rolling units with steplessly radially adjustable rolls and for said rolling units with stepwise radially adjustable rolls.

7. A rolling mill as defined in claim 4, wherein the number of said rolling units, whose rolls are stepwise radially adjustable when the unit is ready for operation, is greater than the number of the rolling units with the rolls which are steplessly radially adjustable.

8. A rolling mill as defined in claim 4, wherein said rolling units, whose rolls are stepwise radially adjustable when the unit is ready for operation, have rolls with a different ideal rolling diameter than said roll units with steplessly radially adjustable rolls.

9. A rolling mill as defined in claim 1, wherein said drive shaft of said rolls and said shafts of said motors extend coaxially to a corresponding roll rotary axis.

10. A rolling mill as defined in claim 1; and further comprising a joint frame, said motors, whose drive shafts forming an angle to a horizontal plane and having the same angular position relative to one another, being arranged on, at or in said joint frame.

11. A rolling mill as defined in claim 10; and further comprising reducer transmissions arranged on said joint frame between said motors and said drive shafts of said rolls.

12. A rolling mill as defined in claim 11, wherein said reducer transmission is formed as a planetary transmission.

13. A rolling mill as defined in claim 11; and further comprising a housing in which said reducer transmissions of several or all said motors with the same angular position are accommodated, said housing being formed as a joint frame.

14. A rolling mill as defined in claim 13, wherein said several or all motors with the same angular position are arranged on said housing of said reducer transmissions, which is formed with said joint frame.

15. A rolling mill as defined in claim 11, wherein said motors and said reducer transmissions of one or several rolls with rotary axes forming an angle of a horizontal plane are assembled to one drive unit.

16. A rolling mill as defined in claim 15, wherein one or several joint frames or drive units are linearly displaceable in direction of associated roll rotary axes.

17. A rolling mill as defined in claim 15, wherein one or several said joint frames of said drive units are turnable about a turning axis extending parallel to said rolling mill axis.

18. A rolling mill as defined in claim 15; and further comprising a linkage mechanism provided for shifting of said joint frames or said drive units.

19. A rolling mill as defined in claim 15; and further comprising a supporting bridge composed of concrete and supporting one or several joint frames or drive units above the rolling mill axis.

20. A rolling mill as defined in claim 1; and further comprising one or several unit changing cars on which one or several rolling units are located, so that said rolling units can be moved from unit changing cars into the rolling line or moved onto said unit changing cars from said rolling line.

21. A rolling mill as defined in claim 20; and further comprising a drive for moving said rolling units, said drive for moving said rolling units being arranged below said motors and said rolls transmissions which have horizontally extending rotary axes, said drive having a plurality of horizontally extending work cylinders which are selectively couplable to at least one associated rolling unit located either out of the rolling mill line on one of said roll unit changing cars, or located in the mill line in a respective roll unit receptacle of the rolling mill.

22. A rolling mill as defined in claim 20; and further comprising a drive for moving said rolling units and including two horizontally extending work cylinders which are arranged in a region of inlet-side and outlet-side end faces of the rolling mill and a shifting beam at operator's side of said rolling units, said shifting beam extending parallel to said rolling mill axis and is engaged by said working cylinders extending transversely to said rolling mill axis, the shifting beam being formed so that each of said rolling units can be selectively coupled with it.

23. A rolling mill as defined in claim 1; and further comprising one or more unit changing cars on which one or more rolling units are arranged, so as to move said rolling units into said rolling line or from said rolling line.

* * * * *

UNITED STATES PATENT AND TRADEMARK OFFICE

CERTIFICATE OF CORRECTION

PATENT NO. : 6,945,084 B2
APPLICATION NO. : 10/371310
DATED : September 20, 2005
INVENTOR(S) : Bindernagel et al.

It is certified that error appears in the above-identified patent and that said Letters Patent is hereby corrected as shown below:

Column 7, line 61 delete the word "cart" and insert the word "can."
Column 8, line 1, delete "one roll in unit" and substitute "one rolling unit."

Signed and Sealed this

Fifth Day of September, 2006

JON W. DUDAS
*Director of the United States Patent and Trademark Office*